US005254027A

United States Patent [19]

McAvoy, Jr.

[11] Patent Number: 5,254,027

[45] Date of Patent: Oct. 19, 1993

[54] ADJUSTABLE PERFORMANCE YO-YO

[76] Inventor: John J. McAvoy, Jr., 1428 SW. 137, Seattle, Wash. 98166

[21] Appl. No.: 806,480

[22] Filed: Dec. 13, 1991

[51] Int. Cl.[5] ..... A63H 1/30

[52] U.S. Cl. ..... 446/250

[58] Field of Search ..... 446/250, 251, 252, 253, 446/254, 249, 248, 247, 236, 257, 256, 261, 263, 264, 266

[56] References Cited

U.S. PATENT DOCUMENTS

| | | | |
|---|---|---|---|
| 2,891,351 | 6/1959 | Madaras et al. | 446/250 |
| 3,805,443 | 4/1974 | Duncan, Jr. | 446/250 |
| 4,207,701 | 6/1980 | Kuhn | 446/250 |
| 4,895,547 | 1/1990 | Amaral | 446/250 |
| 5,017,172 | 5/1991 | Siefert | 446/250 |
| 5,100,361 | 3/1992 | Kuhn et al. | 446/253 X |

FOREIGN PATENT DOCUMENTS

| | | | |
|---|---|---|---|
| 15824 | 4/1904 | Austria | 446/251 |
| 22401 | of 1904 | United Kingdom | 446/251 |
| 209288 | 1/1924 | United Kingdom | 446/250 |
| 504033 | 4/1939 | United Kingdom | 446/266 |

*Primary Examiner*—Robert A. Hafer
*Assistant Examiner*—D. Neal Muir

[57] ABSTRACT

An adjustable performance yo-yo, allowing the operator to optimize the degree of frictional drag maximizing sleep time and being able to return the yo-yo to the hand at will. The invention uses a single nylon woven cord uniquely attached to a yoke on a small diameter threaded axle. Two rotating inertial disks have extended smooth surfaces refered to as lapper disks located near the center of rotation making skimming contact with the cord. The cord frictional drag is adjusted by rotating a threaded knob on the end of the axle which effects the proximity of the lapper disk to the cord. The two inertial disks spin independently of each other. The two body halves are made of a resilient material which cushions the hand from impact of a rapid return of the yo-yo up the cord. A hitch is used to form a running noose on the hand end of the cord. Variations of the invention using a twisted looped string are also disclosed.

7 Claims, 2 Drawing Sheets

ADJUSTABLE PERFORMANCE YO-YO

BACKGROUND OF THE INVENTION

1. Field Of The Invention

This invention relates in general to the field of rotating toys. More specifically it relates to the yo-yo.

2. Description Of Prior Art

The term yo-yo was derived from the equivalent meaning of come-come in the native language of the Philippines where the toy is thought to have evolved from an ancient weapon. Stones with a groove around the periphery have been found in archaeological sites. It is believed that the groove was carved in order to secure twine or strip of leather to the stone. A warrior or hunter could thus throw the stone, quickly recover it and throw it again. Archaeologists have shown that over many years the groove had been made deeper, presumedly at first to allow the twine to be all wound within the groove for the convenience of carrying it. The user would not have thrown the stone from the wound-up condition to wound an animal or an enemy because this would have resulted in primarily rotational speed of the stone instead of linear speed. The first to have carved a deep groove would have allowed the stone to drop while holding the end of the twine only for the purpose of letting the string out. When the stone reached the end of twine and rotated back up the string the come-come was discovered.

In the 1920s a Phillipino named Pedro Flores invented the sleeping yo-yo. Instead of tying the string to the axle, he looped the string around the axle to allow the yo-yo to spin freely in the loop at the end of the string without returning up to the user's hand. This free spinning is referred to as sleeping. The sleep condition is used to perform many trick maneuvers The yo-yo may be returned to the users hand from the sleep condition by a slight jerk of the string. The phenomenon that takes place here is that: Following the jerk, the string becomes slack for a moment and allows the semi-tight loop to wind up on the axle, increasing the frictional drag as more string is wound around the axle and becomes wedged in the gap beteen the inertial masses.

There have been numerous efforts to improve yo-yo performance. A novelty search of prior art relating to the yo-yo discovered the following U.S. patents:

| U.S. Pat. No. | | Classification | Inventor |
|---|---|---|---|
| 1,419,402 | 6/1922 | | Mosher |
| 2,591,954 | 4/1952 | 46/61 | Madsen |
| 2,629,202 | 3/1953 | 46/61 | Stivers et. al. |
| 2,645,881 | 7/1953 | 46/61 | Frangos |
| 2,676,432 | 4/1954 | 46/61 | Field |
| 2,773,328 | 12/1956 | 46/61 | Fraenkel et. al. |
| 2,975,547 | 3/1961 | 46/61 | Greve |
| 3,081,578 | 3/1963 | 46/72 | Mosher |
| 3,175,326 | 3/1965 | 46/61 | Isaacson |
| 3,184,885 | 5/1965 | 46/61 | Gibson |
| 3,256,635 | 6/1966 | 46/61 | Radovan |
| 3,444,644 | 5/1969 | 46/61 | Sayegh |
| 3,805,443 | 4/1974 | 46/61 | Duncan |
| 4,130,962 | 12/1978 | 46/61 | Ennis |
| 4,290,225 | 9/1981 | 46/61 | MacCarthy |
| 4,318,243 | 3/1982 | 46/61 | MacCarthy |
| 4,332,102 | 6/1982 | 46/61 | Caffrey |
| 4,437,261 | 3/1984 | 46/61 | MacCarthy |
| 4,442,625 | 4/1984 | 46/61 | MacCarthy |

A close approach to the disclosed construction and function of the present invention was not observed in the above cited patents. Perhaps of most merit are patents: U.S. Pat. No. 3,256,635 to Radovan claiming radial flutes that grip the string. U.S. Pat. No. 4,130,962 to Ennis claiming cone shaped protuberances to aid the griping of the string. U.S. Pat. No. 2,629,202 to Stivers et. al. claiming varies on the axle surface adjacent to the central polished zone and friction disks with an adhesive characteristic ridgedly mounted on the axle to aid the binding of the string in the gap. These devices do not relate to the initiation of string wind-up. These devices make contact with the string only after the string has made several wraps around the axle and has spread out laterally. This is stated so by Stivers where he refers to the string "... shifted into contact therewith ..." and "... expansion of the loop incident to relaxed tension upon the string." These devices cause the string to fray and shorten string life. The present invention utilizes extended smooth lapper disks where the gap between them is adjustable to make a skimming contact with the cord. U.S. Pat. No. 3,175,326 to Isaacson claims a ball bearing to reduce friction between the string and the shaft to attain longer sleep times. In order to return the yo-yo to the hand, strands of the string must become caught in the circumferential gap between the periphery of the bearing and the rotating body. U.S. Pat. No. 4,332,102 to Caffrey claiming use of a bearing and a centripitally activated clutch to return the yo-yo to the hand. This invention demonstrates the dificulty of making a yo-yo with very low running friction and having the yo-yo reliably return to the hand at will. Both isaacson and Caffrey bearing inventions use a looped and twisted string.

The following improvements to yo-yo construction have been patented: U.S. Pat. No. 2,975,547 to Greve claims the two inertial masses mounted on a split pin, allowing the yo-yo to be assembled in different configurations. U.S. Pat. No. 3,081,578 to Mosher uses a hollow sleeve rotatably journaled on a shaft. The shaft is terminated on each end with an abutment. The abutment is used as part of a means of attachment to a finger to allow the user to grip the shaft with one hand while the string is pulled with the other hand to span the disks. The two inertial disks of this invention are fixed on the sleeve. The floating shaft of this invention is not functionally nor constructurally similar to the present invention. Mosher's invention also has bands of resilient material disposed around the outer maximum periphery of each of the disks for providing a cushioning effect to the disk. The purpose of the resilient material as stated is to cushion the disks—That is to protect the disk. The slight thickness and width of the resilient material is not an effective cushion for the hand. The design of the present invention allows sufficient thickness and width of resilient material to give the feel of catching a rubber ball as the yo-yo returns up the cord to the hand. U.S. Pat. No. 3,805,443 to Duncan Jr. claims the use of a rivet to rigidly clamp the inertial masses to a spool. There are no constructional nor functional equivalences between these inventions and the present invention. U.S. Pat. No. 2,676,432 to Field claims an annular collar with a gap for fixing the string with a knot or flattened end. This is not a sleeping yo-yo. The collar is part of the rotating inertial masses and therefore is not equivalent to the yoke of the present invention.

SUMMARY OF THE INVENTION

The present invention comprises functional changes to the yo-yo which provide improved performance and control. The functional changes consists of a floating axle having a threaded knob on the end, independent rotating inertial disks having smooth lapper disks near the center of rotation, a yoke which reduces friction and provides a means of connecting a single cord to the axle. The two body halves are made of a resilient material each bonded to one of the inertial disks. The resilient bodies gives the feel of catching a rubber ball as the yo-yo returns up the cord to the hand.

The lapper disks are smooth surfaces extending inward from the the inertial disks to make a skimming contact with the cord. The purpose of the independent rotating inertial disks is to allow the adjustment of the lateral proximity of the two lapper disks to the cord. This in effect adjusts the frictional drag of the yo-yo in the sleep condition. The frictional drag in the present invention can thus be optimized to maximize sleep time and still be able to reliably return the yo-yo to the hand at will. The adjustment of frictional drag is made by rotating the threaded knob on the end of the axle. A clockwise rotation will move the two lapper disks closer to the cord.

The primary frictional drag that affects the initial windup of the cord is lateral to the downward thrust of the yo-yo and is thus not significantly effected by the deceleration load when the yo-yo reaches the end of the cord. The yo-yo of the present invention therefore may be thrust downward with great speed and easily achieve the sleep condition. A faster down thrust will result in a higher spin rate and a longer sleep time.

The advantage of using a single cord attached directly to the yoke is that it does not need to be twisted as in all existing configurations of sleeping yo-yo's. The string torque and resulting precession is eliminated.

A hitch is used to form a running noose at the other end of the cord for easy attachment to and detachment from the middle finger the throwing hand.

Variations of the present invention using a twisted looped string are dislosed. The frictional drag is adjusted by string twist to affect string diameter. An increase in string diameter will result in a closer string proximity to the lapper disks and thus increase frictional drag.

DETAILED DESCRIPTION OF THE PREFERED EMBODIMENT

Figure 1:
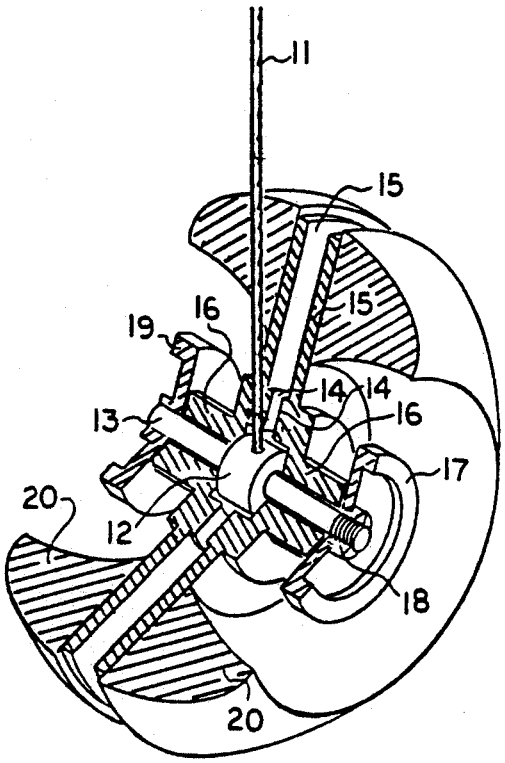
FIG. 1 is an isometric section view of the adjustable performance yo-yo.

Refering now to FIG. 1, an isometric section view of the present invention is shown. a single cord 11 is attached to the yoke 12 which links the cord 11 to the floating axle 13 and acts as a bearing. the smooth lapper disks 14 extend inward from the two inertial disks 15 and make lateral contact with the cord 11. The inertial disks 15 are made of a high density material such as steel or brass. This results in the center of gravity of each of the two rotating assemblies, each consisting of 14, 15, 16 and 20, to be closer to the cord 11. This minimizes unballanced torques during the down thrust. The hubs 16, bonded, welded, stamped or cast as part of the inertial disks 15, exist to maintain the two lapper disks 14 parallel to each other, and also act as bearings to allow the two inertial assemblies, each consisting of 14, 15, 16 and 20, the freedom to slip longitudinally on the axle 13. The knob 17 has a threaded interface 18 with the axle 13. This threaded interface 18 also has a self locking feature as used on standard fasteners. The purpose of the thread self locking feature is to prevent the knob 17 adjustment from shifting during operation. The self locking feature may be placed on the axle 13 threads instead. The other knob 19 is fixed to the axle 13. The knob 17 and 19 are gripped with the fingers, one in each hand, and rotated clockwise to bring the lapper disks 14 into closer proximity to the cord 11 to increase frictional drag. Conversely the knobs 17 and 19 are rotated counter clockwise to reduce friction. The frictional drag in the present invention can thus be optimized to maximize sleep time and still be able to reliably return the yo-yo to the hand at will. This adjustment feature is an advantage because manufacturing tolerances, variations in cord diameter and cord wear effect the skimming action of the lapper disks 14 on the cord 11.

Another advantage of the present invention is that the primary frictional drag that affects the initial wind up of the cord 11 is lateral to the downward thrust of the yo-yo and is thus not significantly effected by the linear deceleration load when the yo-yo reaches the end of the cord 11. The yo-yo of the present invention may thus be thrust downward with great speed and easily achieve the sleep condition.

The two body 20 halves bonded to the inertial disks 15 are made of resilient material such as polyurethane to cushion the hand from impact. A yo-yo thrown down at great speed will also return to the hand with great speed if sleep condition is not achieved. It is an advantage to place the high density material in the plane close to the cord 11 to minimize unballanced torques during the down thrust. In U.S. Pat. No. 4,437,361, MacCarthy states: "It is possible to fabricate the body of the yo-yo from a variety of materials, such as wood; plastic, metal; rubber composite, etc. MacCarthy states no intent to have an inertial disk 15 of high density material such as steel or brass and a separate low density resilient material to cushion the hand as conceived in the present invention.

Figure 2:
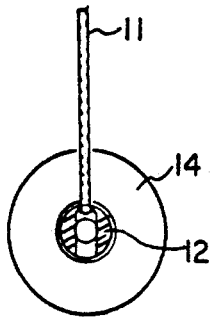
FIG. 2 is a side view of the lapper disks relative to the cord during the sleep condition.
Figure 3:
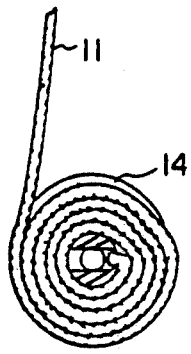
FIG. 3 is a side view of the lapper disks following initial wind up.

Refering to FIGS. 2 and 3, the friction between the cord 11 and the lapper disks 14 is explained. Assume a lapper disk 14 outside and inside diameter of 0.75 and 0.25 inches respectively and a cord diameter of 0.0625. In FIG. 2 with the yo-yo in the sleep condition, the lapper disks 14 make contact with only 0.95 inches of cord 11 length. The contact need only be a slight skim. The yo-yo is returned to the hand from the sleep condition by a slight jerk of the cord 11, which produces a momentary slack in the cord 11. The slack cord 11 is rapidly lapped up between the two lapper disks 14 as shown in FIG. 3, where 6.28 inches of cord length is in direct contact with the two lapper disks 14, increasing the frictional drag by a factor of 25.12. The cord 11 contact length is calculated as follows:

$$\begin{aligned}\text{Cord contact} &= \text{disk area/cord diameter}\\ &= (\pi/4)(D_0^2 - D_1^2)/\text{cord diameter}\\ &= (\pi/4)(.75^2 - .25^2)/0.625\\ &= 6.28 \text{ inches}\end{aligned}$$

This drag is sufficient to initiate the return of the yo-yo to the hand with the remaining cord 11 tightly wedged in the gap between the two inertial disks 15. The binding of the cord 11 in the gap imparts equal angular acceleration to both inertial disks 15 as the adjustable performance yo-yo is thrust downward.

Figure 4:
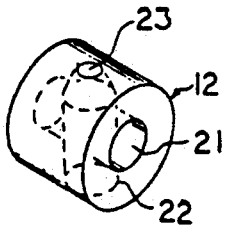
FIG. 4 is an enlarged isometric hidden line view of the yoke.
Figure 5:
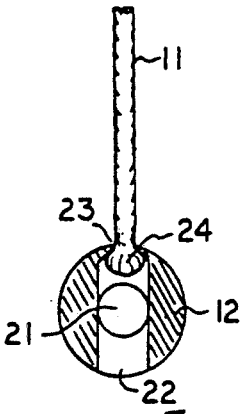
FIG. 5 is an enlarged cross section view of the yoke showing the cord interface.

Refering to FIG. 4 the yoke 12 configuration is shown. The yoke 12 is of a cylindrical shape with a hole 21 passing through the center on the longitudinal axis for the axle 13 to pass through. The surfaces of the hole 21 may be coated with a solid lubricant such as molyebdenum disulfide or teflon to reduce friction. The present invention may be easily disassembled in order to lubricate the yoke 12 and axle with any common lubricant as desired by the user. The cord 11 receptacle 22 is a hole passing through the center of the yoke 12 perpendicular to the axle hole 21. The receptical hole has a funnel shaped exit 23 for trapping the bulbous end of the cord 11 as described in the following: The cord 11 is inserted into the receptical 22 then with a two inches remaining. The flame of a match is used to melt The cord 11 is then pulled through the yoke 12 leaving about two inches remaining. The flame of a match is used to melt the end of the nylon cord 11. A small hard bulb 24 will be formed on the end of the cord 11 as it cools in a manner of seconds. The remaining cord 11 is then pulled through until the bulb 24 is caught in the funnel 23 as shown in FIG. 5. The axle 13 is then inserted in to the hole 21 to verify that the bulb 24 will not interfere with the rotation of the axle 13.

The yo-yo of the present invention is assembled as shown in FIG. 1. The knobs 17 and 19 are rotated clock wise until the lapper disks 14 appear to be making a skimming contact with the cord 11.

Another feature of the present invention is the ease of winding up the cord 11 by hand as described in the following: One of the knobs 17 or 19 is gripped with the fingers and pulled reacting the force with the knuckles against the body 20. This results in the cord 11 being pinched between the two lapper disks 14 so that the cord 11 may be easily wound up in the gap between the two lapper disks 14 and the two inertial disks 15 with the other hand. The yo-yo is now thrust downward. If the yo-yo returns immediately to the hand without sleeping, the knobs 17 and 19 are adjusted counter clockwise to move the lapper disks 14 apart. If the yo-yo sleeps but will riot return to the hand with a slight jerk of the cord 11, the knobs 17 and 19 are adjusted clockwise to move the lapper disks 14 closer to the cord 11. The user may desire to have the adjustment on the tight side to purposely have the yo-yo instantly return to the hand just as in the days of old.

Another advantage of the present invention is that a single cord 11 is used. All sleeping yo-yo's discovered in the novelty search use a looped string twisted to form a single string. This is true in U.S. Pat. No. 3,175,326 by Isaacson and U.S. Pat. No. 4,332,102 by Caffrey where bearings are used. In conventional yo-yo's such as U.S. Pat. No. 2,629,202 by Stivers et. al. and U.S. Pat. No. 3,256,635 by Radovan, string twist is required to form a semitight loop around the axle to create enough frictional drag to initiate string windup when the string is slackened. If the loop is too loose there is zero friction in the slack string condition. String twist is required to provide some degree of friction. The disadvantage of the yo-yo requiring a twisted string is that a torque is produced about the string axis, which in turn causes precession as pointed out by MacCarthy in U.S. Pat. No. 4,437,261. Precession causes the string to rub on the periphery of the yo-yo and thus shortens the sleep time. In the present invention there is no need to twist the cord 11 and thus the tendency to precess is reduced. All other patents with single unlooped strings discovered in the novelty search do not have the ability to sleep.

Figure 6:
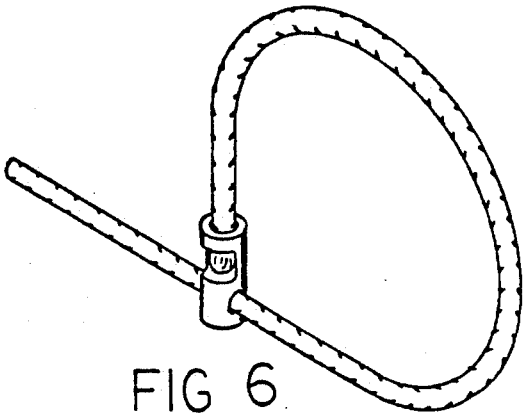
FIG. 6 shows the hitch being used to form a running noose on the hand end of the cord.

Another innovation of the present invention is shown in FIG. 6. A variation of the yoke 12 is the hitch 25 used to form a running noose on the hand end of the cord 11. The cord 11 will not be twisted in the process of winding up by hand if the cord 11 is detached from the hand. Thus easy attachment to, and detachment from the hand allowed by the hitch 25 is usefull addition.

Figure 7:
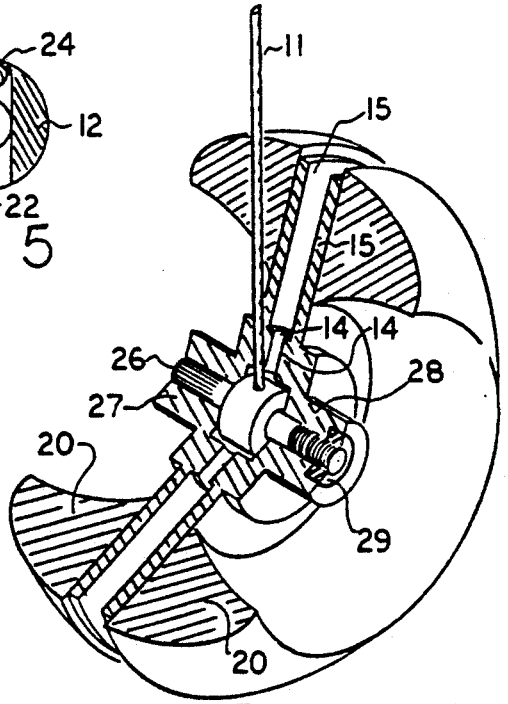
FIG. 7 is an isometric section view of the adjustable performance yo-yo with an axle and hub modification.

A variation of the adjustable performance yo-yo is shown in FIG. 7. One end of the axle 26 is fixed to the hub 27. The other end of the axle 26 is fixed directly into the other hub 28. The adjustment of the lapper disks 14 proximity to the cord 11 is made by rotating the two inertial disks 15 relative to each other by gripping each body 20. A thread locking feature is provided by a nylon plug 29 bonded into the hub 28. The cord 11 is wound by hand by first rotating the two inertial disks 15 clockwise relative to each other to sqeeze the cord 11 between the two lapper disks 14. Next all the cord 11 is wound in the gap between the two inertial disks 15. The two inertial disks 15 are then rotated back counter clockwise to the original desired adjustment.

The adjustable performance yo-yo's shown in FIGS. 1 and 7 may be wound by hand as prior art sleeping yo-yo's are. The cord 11 or the twisted string is pressed against one of the body 20 halves with an index finger of one hand, while the remainder is wound up in the gap over the section pressed in place with the other hand.

The adjustable performance yo-yo's shown in FIGS. 1 and 7 are not limited to a single cord 11 and yoke 12. The conventional looped arid twisted string may be used with out the yoke.

Figure 8:
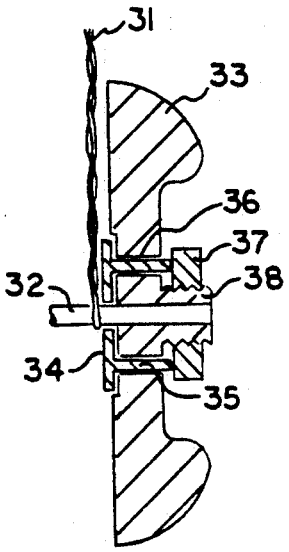
FIG. 8 is a frontal cross section view of the symmetric half of the adjustable performance yo-yo showing a variation of lapper disk and knob construction.
Figure 9:
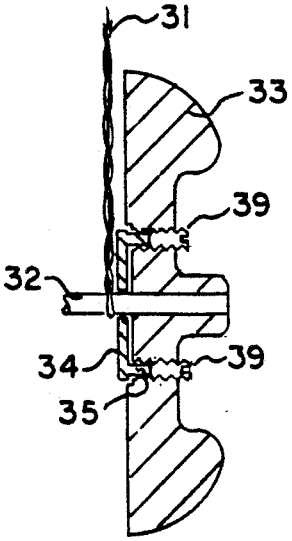
FIG. 9 is a frontal cross section view of the symmetric half of the adjustable performance yo-yo showing use of set screws to adjust the lapper disk position.
Figure 10:
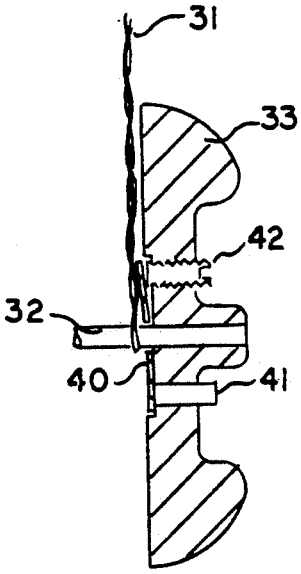
FIG. 10 is a frontal cross section view of the symmetric half of the adjustable performance yo-yo showing use of a set screw to adjust a flexible lapper disk.

Variations in adjustable lapper disks on fixed shaft yo-yos are shown in FIGS. 8, 9 and 10. The views are a frontal cross section of the symmetrical halves. In each of these figures the conventional string 31 is looped about the shaft 32. The shaft 32 is rigidly fixed to the body 33.

Refering to FIG. 8, the lapper disk 34 is rotationally constrained by the pins 35 extending from the back side of the lapper disk 34. The pins 35 protrude through the holes 36 in the body 33. The threaded knob 37 is rotated on the threaded hub 38 against the pins 35 to adjust the proximity of the lapper disk 34 to the string 31.

Refering to FIG. 9, set screws 39 are rotated against the pins 36 to adjust the proximity of the lapper disk 34 to the string 31.

Refering to FIG. 10, a flexible lapper disk 40 is fixed on one edge by the anchor stud 41. The set screw 42 is rotated to deflect the opposite edge of the lapper disk into skimming contact with the string 31.

Figure 11:
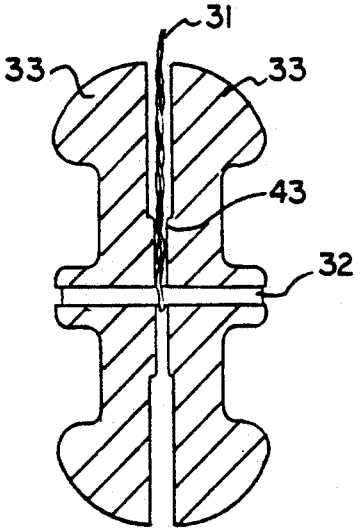
FIG. 11 is a frontal cross section view of a variation of the present invention with a fixed shaft and gap dimension between the lapper disk surfaces.

Refering to FIG. 11, the simplest lapper disk design of the present invention is shown. No lapper disk adjustment is made by the user. The gap between the lapper disk surfaces 43 is set at the factory. In prior art sleeping yo-yos using a looped string, a certain level of frictional drag between the string loop and the shaft is required to initiate the wind up of the string from the sleep condition. The magnitude of the frictional drag is affected by the tightness of the loop about the shaft. The tightness of the loop is affected by the degree of twist in the string. In prior art yo-yos, the shaft diameter has a lower limit because of the need to have sufficient frictional drag between the string loop and the shaft. The shaft diameter of prior art yo-yos are typically 0.25 inches. Imagine a yo-yo with a shaft the size of a sewing needle. The frictional drag would obviously be very low. The string would require a high degree of twist to tighten the loop on the shaft to achieve sufficient frictional drag to initiate string wind up from the sleep condition. As presented above, string twist induces precession during the sleep condition. There is a trade off between shaft diameter and string twist in prior art yo-yos.

Refering again to FIG. 11, the frictional drag in this version of the present invention is also adjusted by the degree of string 31 twist as in prior art looped string yo-yos; however, here the diameter of the string 31 affects the frictional drag or the skimming action of the lapping surfaces 43. Instead of adjusting the position of the lapper disks to skim the the cord 11 or string 31 as described FIGS. 1, 7, 8, 9, and 10, the diameter of the string 31 is adjusted by the degree of twist. Furthermore, the twisted string 31 will be taut in the sleep condition because of the weight of the yo-yo. The twisted string 31 effective diameter will expand increasing frictional drag with the lapping surfaces 43 as the string 31 becomes momentarily slack following the jerk to initiate string 31 wind up from the sleep condition.

Figure 12:
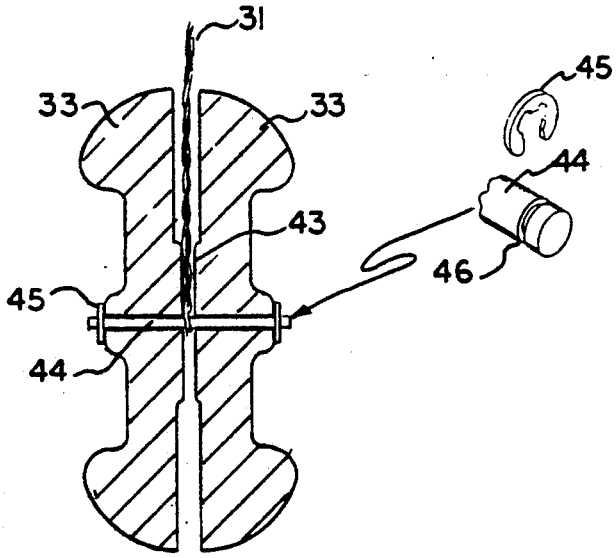
FIG. 12 is a frontal cross section view of a variation of the present invention with a fixed maximum gap dimension between the lapper disk surfaces and a floating axle.

Refering to FIG. 12, a smaller diameter foating axle 44 is used to further reduce frictional drag in the string 31 loop. It is difficult to build a yo-yo with a small diameter fixed shaft. The string 31 wedges between the two body 33 halves and results in spreading forces greater than an attainable pressed fit of a small shaft in the body. The yo-yo shown in FIG. 12 uses standard retainer rings 45 to retain the body halves 33 are the floating axle 44. The retainer rings 45 fit in square groves 46 on the ends of the axle 44. The body halves 33 are independently and rotatably mounted on the axle 44. The smaller diameter shaft 32 and axle 44 are used to minimize the fritional drag in the string 31 loop. Thus the primary frictional drag is lateral which is not affected by the load caused by the linear deceleration of the yo-yo as it reaches the end of the string 31 during the down thrust. Again these versions of the present invention may be thrust down with great speed and easily achieve the sleep condition. A faster down thrust will result in a higher spin rate and a longer sleep time.

What I claim is:

1. An adjustable performance yo-yo comprising in combination:

a. axle means having at least one threaded end, b. yoke means defined as cylindrical bearing means rotatably mounted on a central portion of said axle means and having a conically shaped aperture, c. tether means having bulbous end means captured in said yoke conically shaped aperture, d. two inertial disks, each disk having a hub with cylidrical bearing means, said disks mounted on and allowing independent rotation motion on each end of said axle means, and spaced by said yoke to define a first gap between said two inertial disks, e. flat smooth annular surface means on facing surfaces of each of said inertial disks whereby contact with said tether means extending is effected and whereby the said contact length of said tether is defined by $$(\pi/4)(D_0^2-D_1^2)/d$$

at the completion of slack tether loops wound within the said annular smooth surface means, where $D_1$ and $D_0$ are the inside and outside diameters of said flat smooth annular surface means and d is the diameter of said tether means, and where looping of said tether means causes tether cross section to become oval thereby increasing pressure of said contact between said flat smooth annular surface means and said tether means, f. second surface means on said inertial disks extending radially beyond said flat smooth annular surface means, whereby said gap between the said two inertial disks at said second surface means forms a second gap which is larger than said first gap to inhibit further skimming contact with said tether means and wherein said tether means may be wound in said second gap beyond said flat smooth annular surface means, g. two knob means, one fixed to said axle upon a non-threaded end by press fit, the other with threads interfacing on said axle threaded end whereby relative rotation of said two knobs provides adjustment means of said gap between said two inertial disks.

2. An adjustable performance yo-yo as claimed in claim 1, wherein said tether means is a single braided flexible cord having zero net residual twist.

3. An adjustable performance yo-yo as claimed in claim 1, wherein said tether means has a running noose formed by a hitch member means on that end opposite said yoke means wherein said hitch member means is made of plastic and has an eye means providing a slip joint for an intermediate portion of said tether means and a conical aperture means capturing a second bulbous end means of said tether means opposite said yoke means.

4. An adjustable performance yo-yo as claimed in claim 1, wherein said inertial disks are made of a high density plate material and have a relatively low density resilient body permanently bonded to said inertial disks.

5. An adjustable performance yo-yo as claimed in claim 1, wherein said inertial disks are made of a high density plate material and have a relatively low density body made of one of wood and plastic permanently bonded to said inertial disks.

6. An adjustable performance yo-yo as claimed in claim 1, wherein said inertial disks are made of a high density plate material having a rim means formed on circumference to attach an elastic resilient body.

7. An adjustable performance yo-yo as claimed in claim 1, wherein one of said inertial disks is fixed to said axle means on a non-threaded end by press fit, the other of said disks having internal threads interfacing with said axle threaded end wherein said inertial disks are rotated relative to each other to adjust said gaps.

* * * * *